United States Patent [19]

Morford et al.

[11] 4,215,475

[45] Aug. 5, 1980

[54] OSCILLATING CUT-OUT TOOL

[76] Inventors: Gary W. Morford, 811 W. 25th; Guy Jamieson, 927 E. 6th; Kenneth D. Gould, 1114 E. 6th, all of Hutchinson, Kans. 67501

[21] Appl. No.: 914,787

[22] Filed: Jun. 12, 1978

[51] Int. Cl.[3] ..... B26B 7/00

[52] U.S. Cl. ..... 30/272 R; 30/220; 30/272 A; 30/277

[58] Field of Search ..... 30/272 R, 272 A, 220, 30/277

[56] References Cited

U.S. PATENT DOCUMENTS

| | | | |
|---|---|---|---|
| 287,794 | 11/1883 | Benson | 30/220 |
| 1,117,332 | 11/1914 | Colby | 30/220 |
| 2,652,626 | 9/1953 | Dutcher | 30/220 |
| 2,722,072 | 11/1955 | Aspeek | 30/272 R |
| 2,763,925 | 9/1956 | Asbury | 30/220 |
| 2,859,676 | 11/1958 | Pottol et al. | 30/272 R |
| 2,874,946 | 2/1959 | Singleterry et al. | 30/277 |
| 3,448,517 | 6/1969 | Cothery | 30/317 |
| 3,505,733 | 4/1970 | Holden | 30/272 R |
| 3,924,327 | 12/1975 | Edwards | 30/277 |
| 4,088,369 | 5/1978 | Prater | 30/272 R |

*Primary Examiner*—Othell M. Simpson
*Assistant Examiner*—J. T. Zatarga
*Attorney, Agent, or Firm*—Edwin H. Crabtree

[57] ABSTRACT

An oscillating cut-out tool used for removing windshields from a vehicle. The tool designed to cut through urethane or similar types of material used in securing a vehicle windshield in a windshield frame.

4 Claims, 5 Drawing Figures

OSCILLATING CUT-OUT TOOL

BACKGROUND OF THE INVENTION

The present invention relates generally to a tool having an oscillating cutting blade and more particularly, but not by way of limitation, to an oscillating cut-out tool used for removing windshields from a vehicle.

Heretofore, there have been various types of stripping devices and wallpaper removing tools disclosed in U.S. Pat. No. 3,195,232 to Toth, and U.S. Pat. No. 1,617,924 to Russell. These tools employ an oscillating motion to a cutting blade. Also, a shearing machine using an oscillating blade is disclosed in U.S. Pat. No. 2,125,556 to Gleich. None of the above mentioned tools disclose the unique structure of the subject cut-out tool and its advantages for removing windshields from a vehicle.

In the removal of a windshield from a vehicle, a cutting knife and hammer are used which cause breakage and chipping of the glass windshield. The broken glass often falls into the interior of the vehicle. An alternate way of removing the windshield is the use of piano-type wire which is guided around the circumference of the windshield with one workman holding onto one end of the wire outside the vehicle, while another workman holding the other end of the wire guides the wire from the interior of the vehicle. The above methods of removing the windshield are time-consuming, often cause the windshield to break or chip and present a risk of safety to the workman. The subject invention solves the above described problems in removing a windshield from a vehicle.

SUMMARY OF THE INVENTION

The subject oscillating cut-out tool allows a single workman to remove a windshield from a vehicle approximately five to ten times more quickly than the present methods of removing a windshield.

The invention cuts through urethane or other molding materials used for securing the windshield to the windshield frame and reduces breakage and chipping of the windshield.

The tool is lightweight, inexpensive, easy to operate and may be used by a single workman for removing a windshield. The tool also provides greater safety for the workman and allows him to work outside the vehicle.

The oscillating cut-out tool includes a hand-held motor having a motor drive shaft. The motor is electrically driven or in the alternative could be air or hydraulically operated. An eccentric is attached to the drive shaft. A yoke is disposed around the eccentric. The eccentric imparts an oscillating motion on the yoke when the eccentric is rotated by the drive shaft. One end of an oscillating shaft is attached to the yoke. The other end of the oscillating shaft has an oscillating cutting blade attached thereto. The blade is used for cutting the molding surrounding the outer circumference of the windshield so that the windshield may be removed from its frame in the vehicle.

The advantages and objects of the invention will become evident in the following detailed description when read in conjunction with the accompanying drawings which illustrate the preferred embodiments of the invention.

DETAILED DESCRIPTION OF THE DRAWINGS

Figure 1:
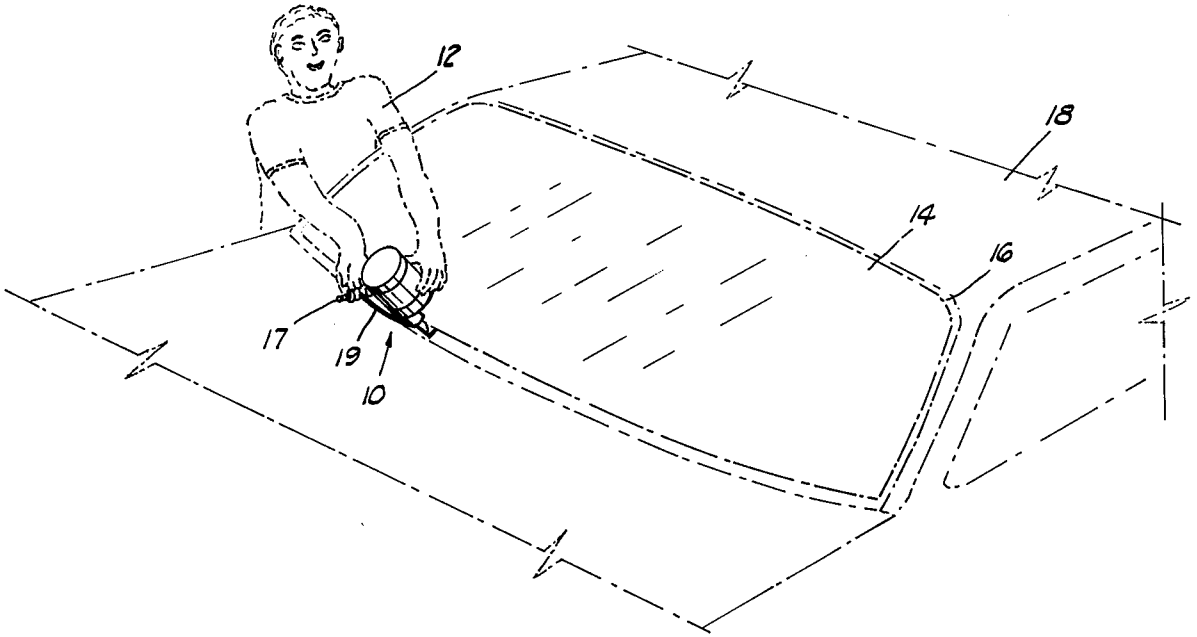
In FIG. 1 a perspective view of the oscillating cut-out tool is shown being held by a workman for removing a windshield from a vehicle.

In FIG. 1 a perspective view of the oscillating cut-out tool is shown. The tool is designated by general reference numeral 10. The tool 10 is hand-held by a workman 12 who guides the tool 10 through the molding which secures a windshield 14 to a windshield frame 16 in a vehicle 18. The tool 10 also includes a handle 17 attached to a cable 19. The cable 19 is attached to the front of the tool 10. The workman 12, by properly guiding the tool 10 with the aid of the handle 17, quickly moves the tool 10 around the circumference of the windshield 14 so that the windshield 14 may be replaced or repaired.

Figure 2A:
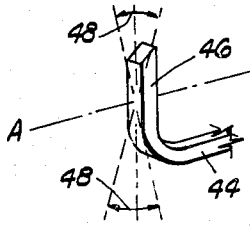
FIG. 2A is a perspective view of a portion of an oscillating cutting blade illustrating its oscillating motion.
Figure 2:
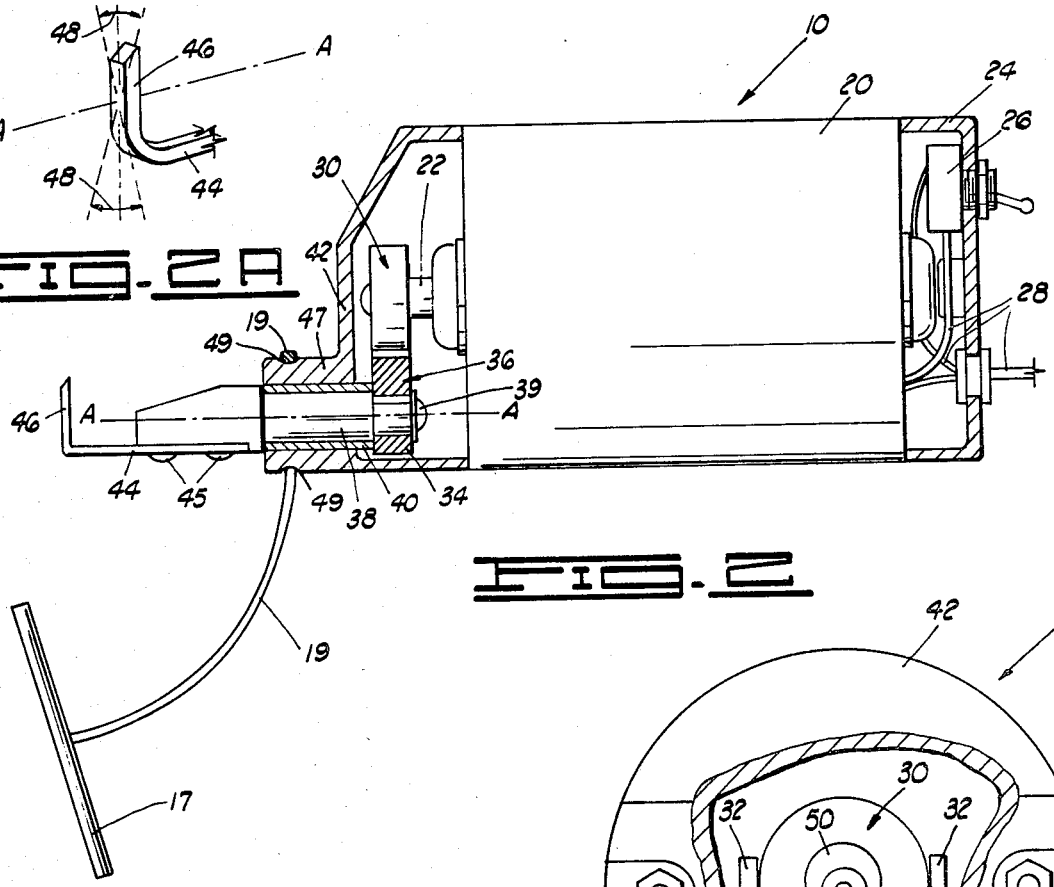
FIG. 2 is a side view of the cut-out tool.

In FIG. 2 a side view of the tool 10 is shown. The tool 10 includes a motor 20 having a motor drive shaft 22 extending outwardly from the front thereof. Attached to the rear of the motor 20 is a rear housing 24 which houses an electrical switch 26 having electrical wiring 28 attached thereto. The switch 26, when the wiring 28 is connected to an electrical outlet turns the motor 20 on and off. While an electrical motor 20 is described, it should be appreciated that the motor 20 could also be an air motor, a hydraulically driven motor, or the like.

Figure 4:
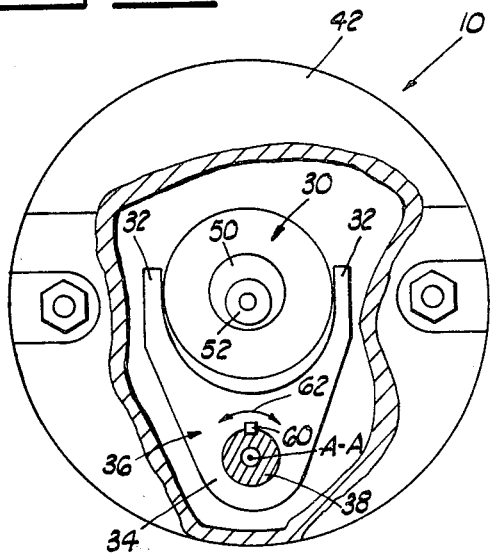
FIG. 4 is a front sectional view of the oscillating cut-out tool.

The end of the drive shaft 22 is attached to an eccentric 30. The eccentric 30 is disposed between a pair of yoke arms 32 attached to a yoke neck 34 of a yoke 36. The yoke arms 32 are seen in FIG. 4. The yoke neck 34 of the yoke 36 is attached to one end of an elongated oscillating shaft 38 by a threaded screw 39. The shaft 38 is mounted on a bushing 40 which is secured to a front housing 42 which encloses the above-described yoke 36, eccentric 30 and drive shaft 22. The other end of the oscillating shaft 38 extends outwardly from the housing 42 and is attached to one end of an oscillating "L" shaped cutting blade 44. While the "L" shaped blade 44 is shown it can be appreciated that various designs of cutting blades may be used to accomplish the same purpose. The blade 44 is attached to the shaft 38 by screws 45.

The shaft 38 and blade 44 extend outwardly from the housing 42 and are parallel to the lower side of the motor 20 for ease in clearing outwardly extending parts of the vehicle 18 as the tool 10 is guided around the windshield 14.

In operation, when the motor 20 is turned on, the motor shaft 22 rotates the eccentric 30. As the eccentric 30 turns, it moves the yoke arms 32 in an oscillating or back and forth motion thereby pivoting the oscillating shaft 38 attached to the yoke neck 34 of the yoke 36 about an axis A—A. The axis A—A extends through the center of the shaft A—A. In turn, the oscillating blade 44 pivots back and forth about the axis A—A. In FIG. 2A, a portion of the blade 44 is shown with an upwardly extending cutting portion 46 of the blade 44 pivoting about axis A—A as indicated by the arrows 48. This oscillating motion imparted on the blade 44 provides means for the blade 44 to quickly cut through urethane, rubber molding, or any other type molding used for securing a windshield 14 to the windshield frame 16 of the vehicle 18.

It should be noted that the housing 42 includes an outwardly extending protrusion 47 having a groove 49 therearound for receiving one end of the cable 19 thereon. The cable 19 turns freely in the groove 49 so that the handle 17 may be rotated as the tool 10 is turned.

Figure 3:
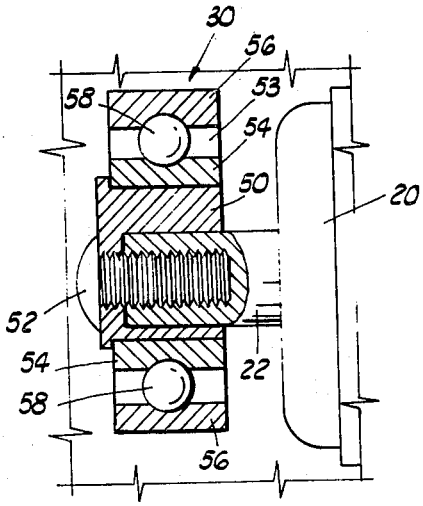
FIG. 3 is an enlarged side sectional view of an eccentric sleeve and ball bearing attached to a drive shaft of a motor.

In FIG. 3 a side sectional view of the eccentric 30 is shown. The eccentric 30 includes an eccentric sleeve 50 disposed around the end of the drive shaft 22 and attached thereto by a threaded bolt 52. The eccentric sleeve 50 is attached to a roller bearing 53 having an inner race 54, an outer race 56 and rolling balls 58 therebetween. The outer circumference of the eccentric sleeve 50 is attached to the inner circumference of the inner race 54. The outer circumference of the outer race 56 is disposed between the yoke arms 32, as shown in FIG. 4. The outer race 56 is held in a fixed position by the yoke arms 32 while the balls 58 and inner race 54 turn in the bearing 53. Through the use of the bearing 53, the eccentric motion of the eccentric sleeve 50 and vibration and noise therefrom is absorbed inside the bearing 53 and frictional wear on the yoke 36 is eliminated.

In FIG. 4 a portion of the front housing 42 is cut away to expose a front view of the yoke 36. In this view, the oscillating shaft 38 can be seen attached to the neck 34 of the yoke 36 by a key 60. The eccentric motion of the yoke 35 is indicated by arrow 62. In this view the pivot axis A—A of the oscillating shaft 38 is shown as a point through the center of the shaft 38.

Changes may be made in the construction and arrangement of the parts or elements of the embodiments as disclosed herein without departing from the spirit or scope of the invention as defined in the following claims:

I claim:

1. An oscillating cut-out tool used for removing a windshield from a vehicle, the tool comprising:

a motor having a motor drive shaft;

an eccentric attached to said drive shaft;

a yoke having a yoke neck and two outwardly extending yoke arms, said eccentric disposed between said yoke arms, said eccentric imparting an oscillating motion on said yoke when said eccentric is rotated by said drive shaft;

an oscillating shaft having one end attached to said yoke neck, said yoke imparting an oscillating motion about an axis along the length of the oscillating shaft and through the center thereof; and an "L" shaped oscillating cutting blade with the long leg thereof attached to the periphery of said oscillating shaft such that the axis of rotation of said shaft with attached blade passes through substantially the mid-portion of the short leg of the "L" shaped blade.

2. The tool as described in claim 1 wherein said eccentric is an eccentric sleeve and a ball bearing having an inner race, an outer race and rolling balls therebetween, said sleeve disposed around said drive shaft and attached thereto, said sleeve also mounted to the inner race of said ball bearing, said yoke arms disposed around the outer race of said ball bearing.

3. An oscillating cut-out tool used for removing a windshield from a vehicle, the tool comprising:

a motor having a motor drive shaft;

a rear housing attached to one end of said motor for receiving switch means therein for turning said motor on and off;

a front housing attached to the other end of said motor and housing said drive shaft therein;

an eccentric sleeve disposed around the end of said motor drive shaft and attached thereto;

a ball bearing having an inner race, an outer race, and rolling balls therebetween, the inner race of said ball bearing attached to the outer circumference of said eccentric sleeve;

a yoke having a yoke neck and outwardly extending yoke arms, the outer race of said ball bearing disposed between said yoke arms, said ball bearing imparting an oscillating motion on said yoke when said eccentric sleeve and said ball bearing are rotated by said drive shaft;

a bushing mounted in said front housing;

an oscillating shaft mounted in said bushing and pivoted thereon, one end of said oscillating shaft attached to said yoke neck, said yoke imparting an oscillating motion about an axis along the length of the oscillating shaft and through the center thereof; and an "L" shaped oscillating cutting blade with the long leg thereof attached to the periphery of said oscillating shaft such that the axis of rotation of said shaft with attached blade passes through substantially the mid-portion of the short leg of the "L" shaped blade.

4. The tool as described in claim 3 further including a cable attached to said front housing and having a handle attached thereto, said handle used for guiding said oscillating cutting blade when the cut-out tool is used for removing a windshield.

* * * * *